US008136495B2

(12) United States Patent
Seitz et al.

(10) Patent No.: US 8,136,495 B2
(45) Date of Patent: Mar. 20, 2012

(54) SWITCHABLE SUPPORT ELEMENT FOR A VALVE TRAIN OF AN INTERNAL COMBUSTION ENGINE

(75) Inventors: Joachim Seitz, Reundorf (DE); Bodo Rörig, Weisendorf (DE)

(73) Assignee: Schaeffler KG, Herzogenaurach (DE)

( * ) Notice: Subject to any disclaimer, the term of this patent is extended or adjusted under 35 U.S.C. 154(b) by 400 days.

(21) Appl. No.: 12/448,970

(22) PCT Filed: Dec. 4, 2007

(86) PCT No.: PCT/EP2007/063263

§ 371 (c)(1),
(2), (4) Date: Jul. 27, 2009

(87) PCT Pub. No.: WO2008/086913

PCT Pub. Date: Jul. 24, 2008

(65) Prior Publication Data

US 2010/0059001 A1 Mar. 11, 2010

(30) Foreign Application Priority Data

Jan. 18, 2007 (DE) ..... 10 2007 002 787

(51) Int. Cl.
*F01L 1/14* (2006.01)

(52) U.S. Cl. ..... 123/90.52; 123/90.48; 123/90.16

(58) Field of Classification Search ..... 123/90.48, 123/90.52, 90.55, 90.16, 90.43
See application file for complete search history.

(56) References Cited

U.S. PATENT DOCUMENTS

| | | | | |
|---|---|---|---|---|
| 5,875,748 | A | 3/1999 | Haas | |
| 2003/0075129 | A1 * | 4/2003 | Spath et al. | 123/90.16 |

FOREIGN PATENT DOCUMENTS

| | | | |
|---|---|---|---|
| DE | 40 00 531 | A1 | 6/1990 |
| DE | 42 06 166 | A1 | 9/1992 |
| DE | 42 10 567 | A1 | 10/1992 |
| DE | 42 44 288 | A1 | 5/1994 |
| DE | 44 04 145 | A1 | 8/1995 |
| DE | 44 40 469 | A1 | 5/1996 |
| DE | 69400358 | | 12/1996 |
| DE | 198 19 068 | A1 | 11/1999 |
| DE | 44 92 633 | C1 | 5/2001 |

(Continued)

*Primary Examiner* — Zelalem Eshete
(74) *Attorney, Agent, or Firm* — Charles A. Muserlian

(57) ABSTRACT

A switchable support element (1) for a valve train of an internal combustion engine, said support element (1) comprising a housing (2) that can be arranged through an outer peripheral wall (3) in a reception of the internal combustion engine and in whose bore (4) an axially movable inner element (6) extends, a head (5) of the inner element (6) protruding beyond an edge (7) of the housing (2), coupling elements (8) being associated to the inner element (6) for a selective coupling of the inner element (6) in an axially extended position of the inner element (6) to the housing (2), and said inner element (6) being biased by at least one lost motion spring (9) in a direction leading out of the housing (2), wherein the coupling elements (8) are at least one slide which, in case of uncoupling, is positioned in a guide (10) of the housing (2) extending in radial or secant direction and which comprises a flattened upper side (12) starting from a radially inner front end (11) of the slide, and this flattened upper side (12) can be brought into engagement with a flattened lower side (13) of a recess (14) in the outer peripheral wall (15) of the inner element (6) for effecting coupling.

15 Claims, 1 Drawing Sheet

FOREIGN PATENT DOCUMENTS

| | | | |
|---|---|---|---|
| DE | 101 19 366 | A1 | 10/2002 |
| DE | 101 22 373 | A1 | 11/2002 |
| DE | 102 10 747 | A1 | 10/2003 |
| DE | 10 2005 003 745 | A1 | 8/2006 |
| DE | 10 2005 003745 | A1 | 8/2006 |
| DE | 10 2006 007 489 | A1 | 9/2006 |
| DE | 44 99 784 | B4 | 9/2006 |
| EP | 1 143 120 | A | 10/2001 |
| EP | 1 462 623 | A | 9/2004 |
| EP | 1 544 422 | A | 6/2005 |
| EP | 1 544 422 | A1 | 6/2005 |
| JP | 61-118514 | | 6/1986 |
| JP | 61-118515 | | 6/1986 |
| JP | 04 094405 | A | 3/1992 |

* cited by examiner

SWITCHABLE SUPPORT ELEMENT FOR A VALVE TRAIN OF AN INTERNAL COMBUSTION ENGINE

This application is a 371 of PCT/EP2007/063263 filed Dec. 4, 2007.

FIELD OF THE INVENTION

The invention concerns a switchable support element for a valve train of an internal combustion engine, said support element comprising a housing that can be arranged through an outer peripheral wall in a reception of the internal combustion engine and in whose bore an axially movable inner element extends, a head of the inner element protruding beyond an edge of the housing, coupling elements being associated to the inner element for a selective coupling of the inner element in an axially extended position of the inner element to the housing, and said inner element being biased by at least one lost motion spring in a direction leading out of the housing.

BACKGROUND OF THE INVENTION

A hydraulically operating support element of the pre-cited type is disclosed in EP 1 411 214 A2 which is considered to be generic. A major drawback of this support element is its relatively large design height due, among other things, to the vertically stacked arrangement of lost motion spring, coupling mechanism and hydraulic unit. It is further noted that in case of a required dismounting (for example for adjusting coupling lash), the pistons arranged as coupling elements in the inner element can only be removed with some difficulty.

In other prior art solutions, a slide forming the coupling element is arranged laterally in the cylinder head and is displaceable for effecting coupling into a corresponding engagement surface of the support element. The person skilled in the art will readily perceive that this requires complex modifications to the design of the cylinder head and that such a device needs an unnecessarily large lateral design space.

OBJECT OF THE INVENTION

The object of the invention is therefore to provide a support element of the pre-cited type in which the aforesaid drawbacks are eliminated.

SUMMARY OF THE INVENTION

The invention achieves the above object by the fact that the coupling elements are at least one slide which, in case of uncoupling, is positioned in a guide of the housing extending in radial or secant direction and which comprises a flattened upper side starting from a radially inner front end of the slide, and this flattened upper side can be brought into engagement with a flattened lower side of a recess in the outer peripheral wall of the inner element for effecting coupling.

Through these measures, the aforesaid drawbacks are eliminated. The support element of the present application has a relatively low axial height and requires no extra or only a slightly larger design space even in radial direction, so that no complex modifications are required in the region of the cylinder head as is the case in the initially cited prior art.

It is particularly advantageous if the support element comprises a hydraulic lash adjuster of a type, known per se, but even mechanical lash adjusting means are conceivable and intended within the scope of the invention.

Although the concept of the invention can be implemented even using only one slide as a coupling element, it is particularly advantageous to use two slides as coupling elements situated diametrically opposite each other. The invention preferably uses piston-like elements which, starting from their radially inner front end, are flattened on their upper side and, according to a particularly advantageous further feature of the invention, engage into a recess on the outer peripheral wall of the inner element, said recess being configured as a transverse slit comprising a straight slit base extending in secant direction.

Alternatively, an annular segment or a sickle-shaped configuration may be associated to each slide used as a coupling element, it being, however, also possible to use a circumferential or partially circumferential annular groove on the outer peripheral wall of the inner element for effecting coupling.

It is understood that a person skilled in the art will conceive further configurations for the coupling elements in this context, such as, for instance, flat slides or the like. Where appropriate, it is conceivable and intended to arrange a plurality of circumferentially spaced slides as coupling elements extending in radial direction within the housing.

By reason of the proposed flattened coupling construction, only negligible contact pressures are to be expected in the coupling region.

As a simple and design space-saving displacement means for the slides in coupling direction, the invention proposes to arrange on the outer peripheral wall of the housing at least one clip-like spring whose end pieces act on the outer front ends of the slides constituting the coupling elements. At the same time, this clip-like spring can also embody an anti-rotation feature for the slide or slides forming the coupling elements by providing the end pieces, for example, with a hook-shaped depression, or the like, which is then seated in a corresponding complementary longitudinal slot on the outer front end of the coupling element. Alternatively, it is also possible to let "smooth" end pieces extend in a circumferential slot of each slide.

According to a further advantageous feature of the invention, an anti-rotation device such as a pin or a ball is arranged between the inner element and the housing. Where appropriate, flattened portions can also be used in this region to form an anti-rotation feature of the inner element relative to the housing.

According to a further advantageous proposition of the invention, in case a pin is used, this pin can comprise a flattened lower and upper side so that vertical stops for the inner element relative to the housing are formed on both sides. If desired, it is also possible to create a vertical stop only on one side.

Besides this, it is also imaginable and intended to adjust a coupling lash through the pin as an anti-rotation device, needing no further elucidation at this point. For this purpose, pins grouped according to a height of their lower sides are kept available during the assembly procedure.

Alternatively, the coupling lash can also be adjusted through off-the-shelf slides grouped according to a height of their flattened upper sides.

A re-displacement of the slides in uncoupling direction completely into the guide of the housing is appropriately effected through a hydraulic medium. This can be routed via an annular groove on the outer peripheral wall of the housing through at least one cross-bore to the inner front end of the corresponding slides.

As lost motion spring, the invention proposes at least one coiled compression spring or the like, that acts at one end against a lower side of the inner element and at another end against a bottom of the housing. For a further reduction of the design height, the base of the inner element can also have a stepped configuration, so that the lost motion spring surrounds, at least partially peripherally, a high pressure chamber arranged in the inner element.

BRIEF DESCRIPTION OF THE DRAWING

The invention will now be described more closely with reference to the appended drawing.

DETAILED DESCRIPTION OF THE DRAWING

Figure 1:
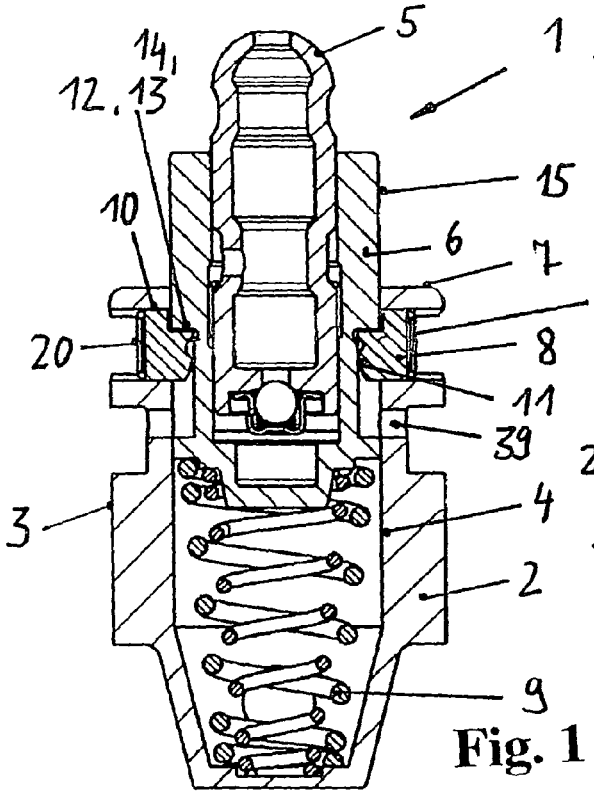
FIG. 1 shows a longitudinal section through a support element of the invention, taken in a region of slides of the support element.

The figures show a switchable support element 1 for a valve train of an internal combustion engine. The support element 1 comprises a pot-shaped housing 2 in whose bore 4 an inner element 6 is received for axial displacement, a head 5 of the inner element 1 extending beyond an edge 7 of the housing 2. The head 5 is a constituent part of a pressure piston 31 of a hydraulic lash adjuster installed in a bore 29 of the inner element 6.

In its head-distal region, said pressure piston 31 comprises a crossbar 32 comprising a one-way valve 33 which opens in direction of a high pressure chamber 35 which is situated below the one-way valve 33 and defined in head-distal direction by a base 34 of the inner element 6.

A lost motion spring 9 configured as a stack of springs extends between the base 34 of the inner element 6 and a bottom 37 of the housing 2.

Two slides as coupling elements 8 are situated diametrically opposite each other in the housing 2. These slides or coupling elements 8 are seated in respective guides 10 of the housing 2 and comprise, starting from their radially inner front ends 11, stepped upper sides 12.

Figure 3:
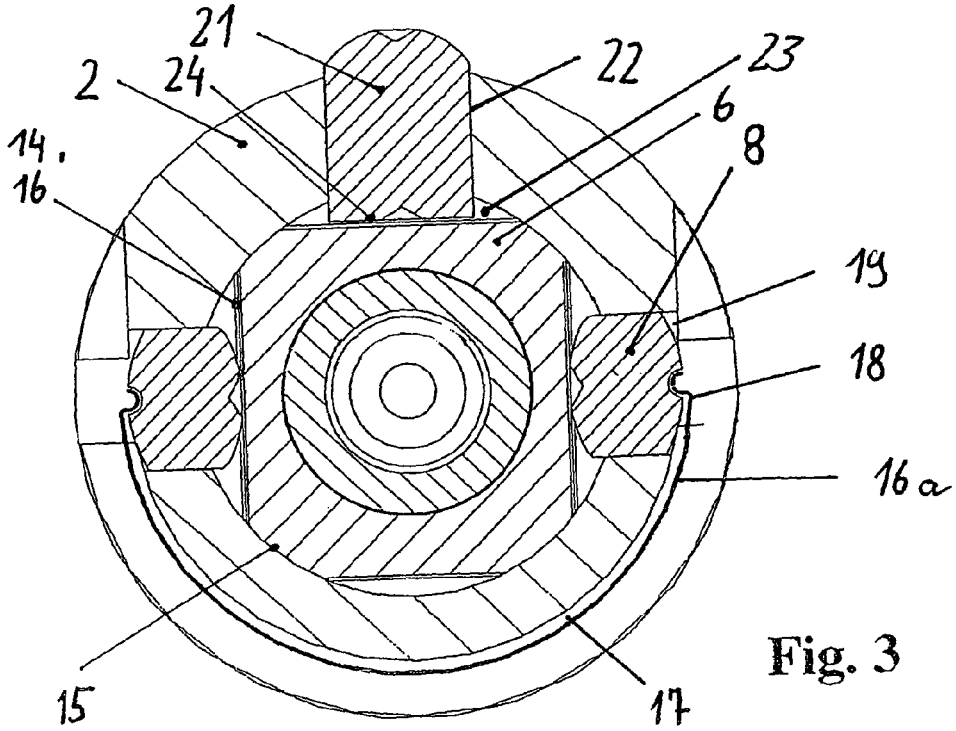
FIG. 3 shows an enlarged representation of a cross-section through the support element of the invention taken in the region of the slides.

The coupling elements 8 are shown in FIG. 1 in their coupled state in which the flat upper sides 12 cooperate with flat lower sides 13 of corresponding recesses 14 configured in the outer peripheral wall 15 of the inner element 6. As best seen in FIG. 3, the recesses 14 are configured as transverse slits comprising a straight slit bottom 16 extending in secant direction.

A radially inward displacement of the slides as coupling elements 8 in their coupling direction is effected through the force of a bow-shaped spring 16*a* which is biased in inward direction. This spring 16*a* acts through its end pieces 18 on outer front ends 19 of the slides constituting the coupling elements 8. A guidance and anti-loss feature for the spring 16*a* is created through a continuous groove 17 on the outer peripheral wall 3 of the housing 2, the end pieces 18 of the spring 16*a*, which in the present configuration comprise hook-shaped depressions, extend, at the same time, through positive engagement in longitudinal slots 20 of the outer front ends 19 of the slides as coupling elements 8. In this way, a simple anti-rotation feature for the slides as coupling elements 8 relative to their guides 10 is created.

Figure 2:
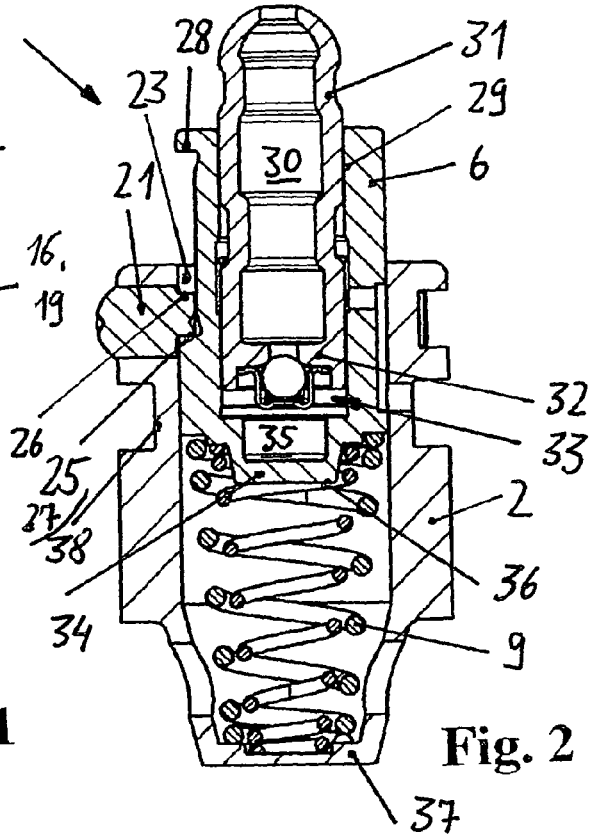
FIG. 2 shows a longitudinal section corresponding to FIG. 1 but turned through 90° and comprising an anti-rotation device.

At the same time, FIGS. 2, 3 also disclose that the inner element 6 is retained relative to the housing 2 through a pin-like anti-rotation device 21 which is fixed in a recess 22 of the housing 2. This anti-rotation device 21 comprises, starting from its radially inner front end 24, a flattened lower side 25 and a flattened upper side 26 which flattened lower and upper sides 25, 26 limit displacements of the inner element 6 in its two directions of travel and, if desired, enable a coupling lash of the coupling elements 8 in an axially extended condition. By reason of the aforesaid anti-rotation device, a reliable positional association of the slides as coupling elements 8 to their recesses 14 is realized.

A return displacement of the slides as coupling elements 8 in uncoupling direction is effected through hydraulic medium. For this purpose, the outer peripheral wall 3 of the housing 2 comprises an annular groove 38 out of which two opposing cross-bores 39 extend through the housing 2. Through these cross-bores 39 hydraulic medium can be routed into an annular space in front of radially inner front ends 11 of the slides as coupling elements 8. As can be clearly seen, the radially inner front ends 11 of the slides as coupling elements 8 have a generally convex shape, so that a "good" delivery of hydraulic medium to these is guaranteed.

The housing 2 represented in the drawings may have a solid configuration but may also be configured as a deep-drawn or extrusion molded light-weight component.

The invention claimed is:

1. A switchable support element for a valve train of an internal combustion engine, said support element comprising a housing that can be arranged through an outer peripheral wall in a reception of the internal combustion engine and in whose bore an axially movable inner element extends, a head of the inner element protruding beyond an edge of the housing, coupling elements being associated to the inner element for a selective coupling of the inner element in an axially extended position of the inner element to the housing, and said inner element being biased by at least one lost motion spring in a direction leading out of the housing, wherein the coupling elements are at least one slide which, in case of uncoupling, is positioned in a guide of the housing extending in radial or secant direction and which comprises a flattened upper side starting from a radially inner front end of the slide, and this flattened upper side can be brought into engagement with a flattened lower side of a recess in the outer peripheral wall of the inner element for effecting coupling, the recess of the inner element is configured as one of a transverse slit comprising a straight slit base, an annular segment or a sickle-shaved portion in the outer peripheral wall of the inner element and is arranged opposite the respective slide as coupling element.

2. A support element according to claim 1, wherein the recess of the inner element is made as a circumferential annular grove.

3. A support element according to claim 1, wherein the exactly two slides situated diametrically opposite each other are arranged as coupling elements in the guide of the housing.

4. A support element according to claim 1, wherein each slide as coupling element is configured as a piston and the guide of the piston in the housing is configured as a bore, the flattened upper side of the piston being part of a stepped recess starting from the radially inner front end of the piston.

5. A support element according to claim 4 wherein a displacement of the two slides as coupling elements in coupling direction is realized through the force of at least one bow or clip-shaped spring biased radially inwards, which spring is one of in bearing relationship with the outer peripheral wall of the housing or guided in a circumferential groove in the outer peripheral wall of the housing and acts through end pieces or regions of an inner peripheral surface on outer front ends of the slides as coupling elements.

6. A support element according to claim 5, wherein as an anti-rotation feature, the end pieces of the spring are seated through a region of a hook-shaped depression in longitudinal slots of the outer front ends of the slides as coupling elements.

7. A support element according to claim 1, wherein as an anti-rotation device is arranged between the inner element and the housing.

8. A support element according to claim 7, wherein as an anti-rotation device is one of a pin or a ball that is fixed in a recess of one of the housing and the inner element and cooperates with a longitudinal recess in the other one of the inner element and the housing.

9. A support element according to claim 8, wherein as an anti-rotation device is a pin arranged in the recess of the housing and comprises, starting from a radially inner front end, a flattened lower side and a flattened upper side, these flattened lower and upper sides forming lower and upper vertical stops which cooperate with opposing stop surfaces of the longitudinal recess of the inner element, whereby, in an axially extended stop position of the inner element, the slides as coupling elements are in correct positional alignment with the recesses of the inner element.

10. A support element according to claim 9, wherein an adjustment of a coupling lash is effected through the pin forming the anti-rotation device, said pin being stocked grouped according to a height of the lower side.

11. A support element according to claim 1, wherein an adjustment of a coupling lash is effected through the respective slide as coupling element, said slide being stocked grouped according to a height of the upper side.

12. A support element according to claim 1, wherein the support element comprises hydraulic lash adjustment.

13. A support element according to claim 12, wherein a pressure piston forming a constituent part of the inner element and comprising a reservoir for hydraulic medium extends in a bore of the inner element and comprises the head, a one-way valve extends on a head-distal crossbar and a high pressure chamber for the hydraulic medium is formed axially between the crossbar and a head-distal base of the inner element, the recess for the slide as coupling element on the outer peripheral wall of the inner element being situated at least partially radially next to or above the high pressure chamber.

14. A support element according to claim 1, wherein the lost motion spring is formed by at least one coiled compression springs which act at one end against a lower side of the inner element and at another end against a bottom of the pot-shaped housing.

15. A support element according to claim 1, wherein a displacement of the at least one slide as coupling element in uncoupling direction can be realized through hydraulic medium for whose routing an annular groove, or a recess such as a bore, extends on the outer peripheral wall of the housing axially below the respective guide, from which annular groove the hydraulic medium can be routed via at least one cross-bore, through the housing, into the recess radially inwards to the front end of the slide as coupling element.

* * * * *